US005291173A

United States Patent [19]

Yerman et al.

[11] Patent Number: 5,291,173

[45] Date of Patent: Mar. 1, 1994

[54] Z-FOLDABLE SECONDARY WINDING FOR A LOW-PROFILE, MULTI-POLE TRANSFORMER

[75] Inventors: Alexander J. Yerman, Scotia; Waseem A. Roshen, Clifton Park, both of N.Y.

[73] Assignee: General Electric Co., East Windsor, N.J.

[21] Appl. No.: 838,958

[22] Filed: Feb. 21, 1992

[51] Int. Cl.[5] ..... H01F 27/28

[52] U.S. Cl. ..... 336/183; 336/200; 336/223; 336/232

[58] Field of Search ..... 336/183, 200, 232, 206, 336/223, 180, 182, 192

[56] References Cited

U.S. PATENT DOCUMENTS

| | | | |
|---|---|---|---|
| 2,921,165 | 1/1960 | Clark | 336/223 |
| 3,002,260 | 10/1961 | Shortt et al. | 336/200 |
| 3,495,327 | 2/1970 | Fisler | 336/223 |
| 4,641,114 | 2/1987 | Person | 336/232 |
| 4,803,453 | 2/1989 | Tomono et al. | 336/200 |
| 4,943,793 | 7/1990 | Ngo et al. | 336/223 |
| 4,959,630 | 9/1990 | Yerman et al. | 336/183 |
| 5,017,902 | 5/1991 | Yerman et al. | 336/183 |

*Primary Examiner*—Thomas J. Kozma

*Attorney, Agent, or Firm*—J. M. Breedlove; C. A. Berard; S. A. Young

[57] ABSTRACT

A high-frequency, low-profile transformer having at least one pair of magnetic poles includes a primary winding having a z-folded, continuous primary conductive film with a generally serpentine configuration disposed on a primary dielectric membrane and further includes a z-folded, continuous secondary winding constructed from a plurality of secondary conductive film portions disposed on a secondary dielectric membrane. Each of the secondary conductive film portions is configured to form a single continuous path enclosing each of the magnetic poles in such manner that each path encloses one pole of each pair of the magnetic poles of each adjacent layer of the secondary winding. Each path thus continues along a respective fold of the winding stack. The secondary winding layers are interleaved with the primary winding layers and electrically connected together. In one preferred embodiment, the transformer has two pairs of magnetic poles, and each path formed by each secondary conductive film has a shape characterized as two generally ovoid portions connected together at a relatively wide midportion. Low-resistance conductive bridges are used to electrically connect the secondary conductive film portions together along alternate folds of the winding stack.

8 Claims, 3 Drawing Sheets

Z-FOLDABLE SECONDARY WINDING FOR A LOW-PROFILE, MULTI-POLE TRANSFORMER

RELATED APPLICATIONS

This application is related to commonly assigned, copending U.S. patent application, Ser. No. 838,656, of W. A. Roshen and A. J. Yerman and to commonly assigned, copending U.S. patent application, Ser. No. 07/838,953, of W. A. Roshen, A. J. Yerman and G. S. Claydon, both filed concurrently herewith and incorporated by reference herein.

FIELD OF THE INVENTION

The present invention relates generally to magnetic components and, more particularly, to low-profile, z-foldable, conductive-film magnetic components.

BACKGROUND OF THE INVENTION

Commonly assigned, copending U.S. patent application of A. J. Yerman and W. A. Roshen, Ser. No. 07/548,461, now U.S. Pat. No. 5,126,715 and incorporated by reference herein, describes a low-profile, multi-pole, conductive-film transformer. The transformer of Ser. No. 07/548,461 includes a continuous, serpentine primary winding that is configured and z-folded to form a multi-pole, multi-layer winding having separate secondary winding layers interleaved therewith. Conductive connecting strips are used to electrically connect the separate secondary winding layers together. Although the conductive-film transformer of Ser. No. 07/548,461 is a low-profile device, it is desirable to improve such a conductive-film transformer even further by providing a continuous, z-foldable, multi-pole secondary winding configuration that allows for easier and more reliable high-current and lower-resistance connections between secondary winding layers.

SUMMARY OF THE INVENTION

A high-frequency, low-profile transformer having at least one pair of magnetic poles includes a primary winding comprising a z-folded, continuous, primary conductive film having a generally serpentine configuration and being disposed on a primary dielectric membrane. The low-profile transformer further includes a z-folded secondary winding comprising a continuous secondary conductive film constructed from a plurality of secondary conductive film portions disposed on a secondary dielectric membrane. Each of the secondary conductive film portions is configured to form a single continuous path enclosing each of the magnetic poles in such manner that each path encloses one pole of each pair of the magnetic poles of each adjacent layer of the secondary winding. Each path thus continues along a respective fold of the winding stack. The secondary winding layers are interleaved with the primary winding layers. Advantageously, the secondary winding layers are easily and reliably connected together by low-resistance conductive bridges at alternate fold lines.

In one preferred embodiment, a transformer according to the present invention has two pairs of magnetic poles, and each path formed by each secondary conductive film portion has a shape comprising two generally ovoid portions connected together at a relatively wide midportion.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
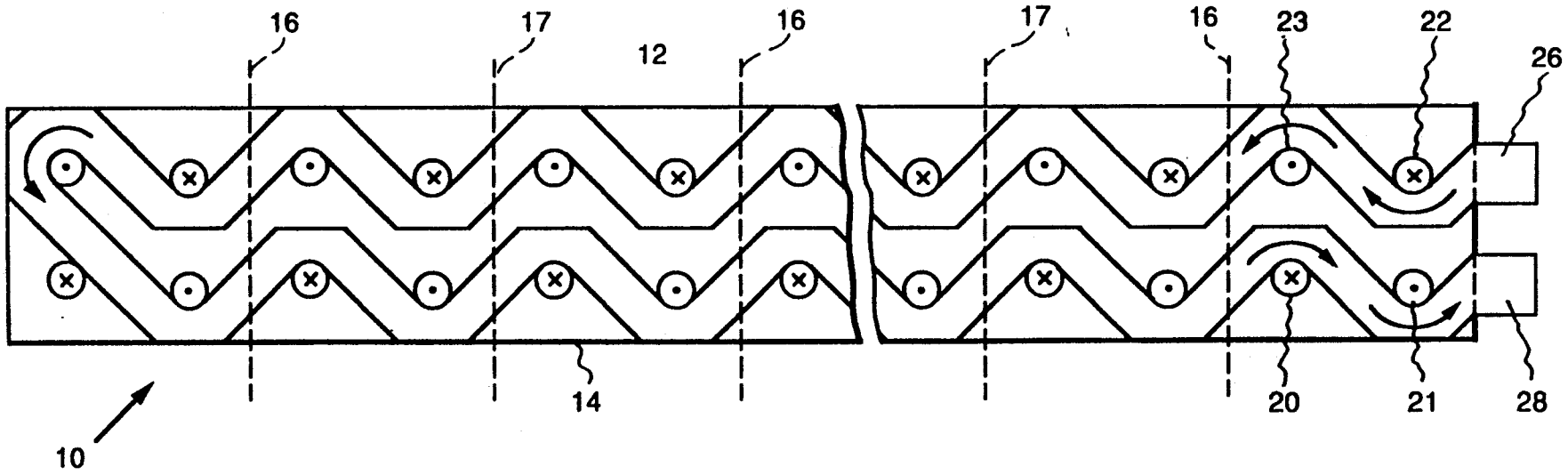
FIG. 1 is a plan view of a primary winding useful in a transformer according to the present invention.

FIG. 1 illustrates a primary winding 10 according to the hereinabove cited U.S. patent application of A. J. Yerman and W. A. Roshen, Ser. No. 07/548,461, which is useful in a low-profile transformer according to the present invention. In particular, primary winding 10 includes a continuous primary conductive film 12 having a generally serpentine configuration disposed on a dielectric membrane 14. Although primary winding 10 is shown as having a primary conductive film disposed on only one surface of dielectric membrane 14, another primary conductive film (not shown) may be situated on the other surface of dielectric membrane 14, if desired. Dotted lines 16 and 17 represent fold lines for z-folding the primary conductive film, as described in patent application Ser. No. 07/548,461, cited hereinabove. Specifically, fold lines 16 indicate folding in one direction; and fold lines 17 indicate folding in the opposite direction. Primary winding 10 is thus configured to have at least one winding turn about each of two pairs of magnetic poles 20–21 and 22–23. The corresponding openings for poles 20–23 are sized to receive core posts of a suitable magnetic core, such as, for example, the magnetic core described in U.S. patent application Ser. No. 07/838,656, cited hereinabove. By way of illustration, X's are provided to indicate that the direction of magnetic flux within the respective poles extends downward, and dots are provided to indicate that the direction of magnetic flux within the respective poles extends upward. Each arrow indicates the corresponding direction of current flow. Primary winding terminals 26 and 28 extend outward from one end, i.e., the bottom or top, of the multi-layer primary winding stack after folding.

Figure 2A:
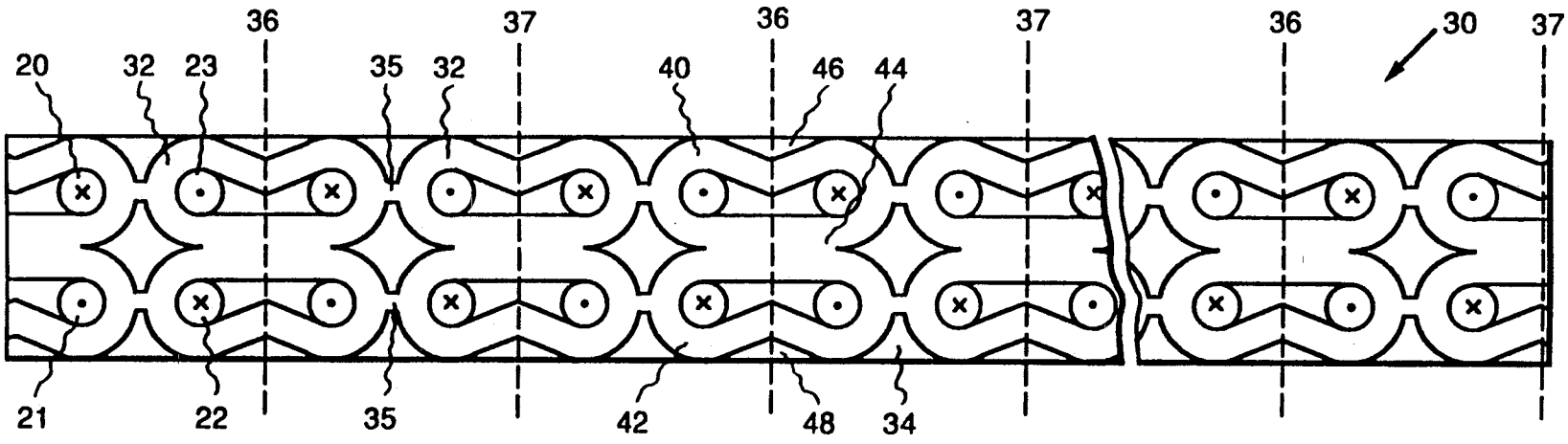
FIG. 2*a* is a top plan view of a preferred embodiment of a secondary winding useful in a transformer according to the present invention.
Figure 2B:
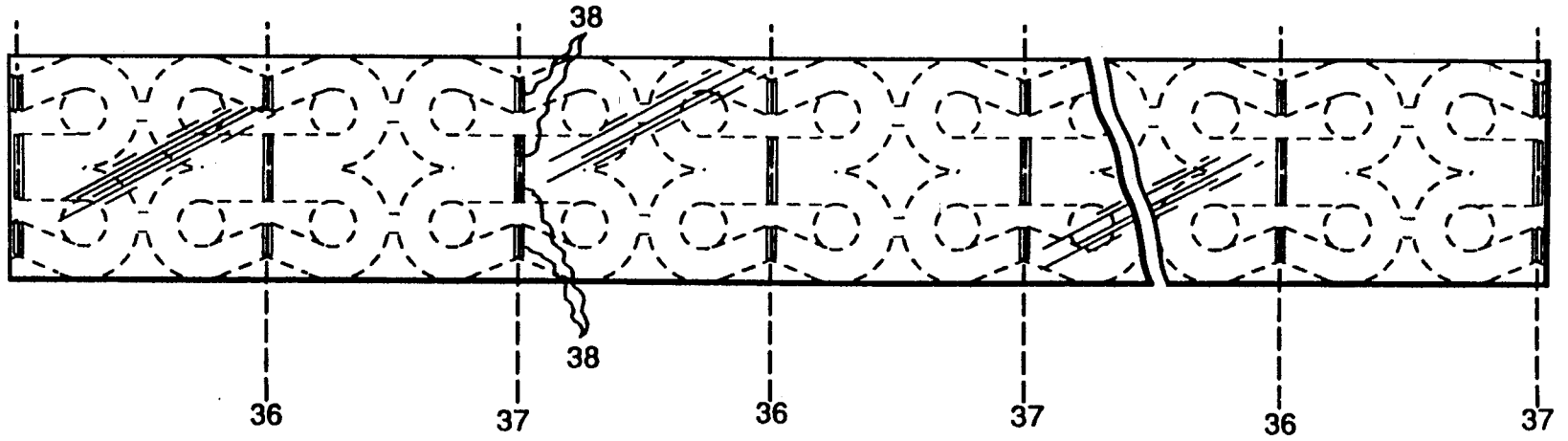
FIG. 2*b* is a bottom view of the secondary winding of FIG. 2*a*.

FIG. 2*a* illustrates a top view and FIG. 2*b* illustrates a bottom view of a secondary winding 30 which is to be z-folded and interleaved with primary winding 10 of FIG. 1 to form a low-profile transformer according to the present invention. Secondary winding 30 comprises a secondary conductive film constructed from a plurality of secondary conductive film portions 32 disposed on a dielectric membrane 34. Each conductive film portion 32 is configured to form a single continuous path enclosing each pole of two pairs of magnetic poles in such manner that each path encloses one of each pair of the magnetic poles of each adjacent layer of the secondary winding. Each path thus continues from one layer to the next along a respective fold of the multi-layer stack of windings. Preferably, as shown, adjacent conductive film portions 32 on each layer are connected together by small conductors 35 in order to provide even more reliable parallel connections between secondary winding layers. Fold lines 36 and 37 indicate folding in opposite directions to form a multi-layer z-folded winding stack with fold lines 36 and 37 being situated on opposite sides of the stack of secondary winding layers. Vias 38 are provided along fold lines 36, i.e., on one side of the secondary winding stack, in order to provide secondary winding connections, as described hereinbelow with reference to FIG. 3. Furthermore, similar to primary winding 10, it is to be understood that although a secondary conductive film is shown as being disposed on only one surface of dielectric membrane 34, another secondary conductive film may be situated on the other surface of dielectric membrane 34, if desired.

In one preferred embodiment, as shown in FIG. 2, each conductive film portion 32 has a shape comprising two generally ovoid portions 40 and 42 connected together at a relatively wide midportion 44. Preferably, as shown, the outer portion of each ovoid portion is drawn inwardly, e.g., so as to form a substantially V-shaped dielectric portion 46 and 48, respectively, in order to reduce the conductive area near the edge of the winding, thereby decreasing leakage inductance and reducing eddy current losses in the conductive film that is not fully utilized for current conduction.

Conductive films 12 and 32 of primary and secondary windings 10 and 30, respectively, comprise any suitable conductive material, e.g., copper or aluminum; and dielectric membranes 14 and 34 comprise any suitable dielectric material, e.g., Kapton polyimide film or Mylar polyester film manufactured by E. I. du Pont de Nemours and Company.

Figure 3:
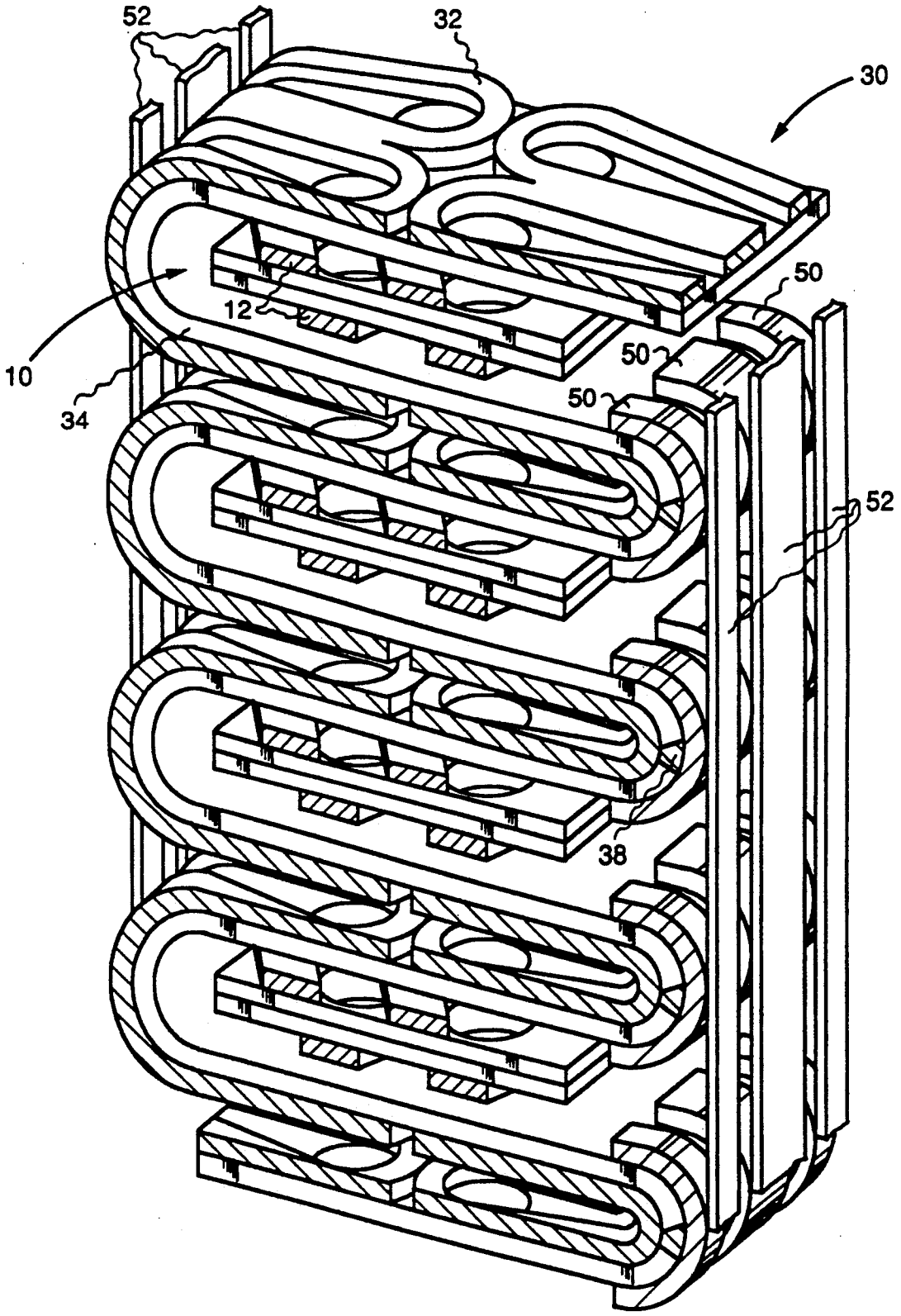
FIG. 3 is a cross sectional, perspective view of a transformer according to the present invention.

FIG. 3 illustrates a cross section of a transformer according to the present invention including a primary winding 10, such as that of FIG. 1, and a secondary winding 30, such as that of FIG. 2. Primary winding 10 is interleaved with secondary winding 30 so that fold lines 16 and 17 (FIG. 1) are respectively displaced 90° with respect to fold lines 36 and 37 (FIG. 2), respectively. Additional dielectric layers (not shown) provide insulation between primary and secondary conductive films that face each other, as needed, as will be appreciated by those of ordinary skill in the art.

Easy and reliable, high-current, low-resistance connections are made between secondary winding layers. In particular, on the side of the secondary winding stack having conductive film portions 32 facing inward after folding (shown as the right side in FIG. 3), conductive bridges 50 and vias 38 are used to connect secondary winding layers together along alternate folds. Connecting strips 52 are soldered to conductive bridges 50. On the opposite side of the stack which has conductive film portions 32 facing outward (shown as the left side in FIG. 3), connecting strips 52 are soldered directly to conductive film portions 32; i.e., no additional conductive bridges are needed. Advantageously, connecting strips 52 allow for easy and reliable, high-current, low-resistance connections to other circuit elements.

A secondary winding according to the present invention is preferably fabricated as a continuous strip. Specifically, a method for fabricating a secondary winding according to the present invention involves a photolithographic patterning process. Initially, a light-sensitive photoresist layer comprised of a resist such as, for example, Laminar semi-aqueous resist type AX20 manufactured by Dynachem Corporation, is laminated to both sides of a laminate comprising, for example, copper laminated to both surfaces of a Kapton polyimide film. The photoresist is then exposed using a mask pair according to well-known methods in order to shape the dielectric layer and provide openings therein for magnetic pole penetration or where vias 38 are needed, as shown in FIG. 2*b*. This is done by etching away copper where dielectric is to be removed and then suitably etching the dielectric using a plasma or wet chemicals which react with the dielectric where it is exposed. After etching the dielectric pattern, photoresist is again applied to both sides of the laminate, and a second mask pair is used to configure the final copper conductor shape.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A transformer, comprising:

a primary winding comprising a continuous primary conductive film having a generally serpentine configuration and being disposed on a primary dielectric membrane, said primary conductive film being z-folded to form a multi-layer primary winding having at least one turn about each of at least one pair of magnetic poles; and a secondary winding comprising a continuous conductive film constructed from a plurality of secondary conductive film portions disposed on a secondary dielectric membrane, said secondary winding being z-folded to form a multi-layer secondary winding interleaved with said multi-layer primary winding, each of said secondary conductive film portions being configured to form a single continuous path enclosing each of said magnetic poles in such manner that each said path encloses one pole of each pair of said poles of each adjacent layer of said secondary winding, each said path thereby continuing along a respective fold of the multi-layer stack of windings, said secondary winding further comprising connecting means for electrically connecting said secondary conductive films together.

2. The transformer of claim 1, comprising two said pairs of magnetic poles.

3. The transformer of claim 2 wherein each said path formed by each of said secondary conductive film portions has a shape comprising two generally ovoid portions connected together at a midportion.

4. The transformer of claim 3 wherein said connecting means comprises conductive bridges and vias for connecting adjacent secondary winding layers together along alternate folds on the side of said stack wherein the secondary conductive film portions are folded toward each other, said connecting means further comprising conductive connecting strips for connecting the conductive bridges together and for directly connecting the secondary conductive films together on the opposite side of said stack.

5. A winding for a magnetic circuit component, comprising:

a continuous conductive film constructed from a plurality of conductive film portions disposed on a dielectric membrane, said winding being z-folded to form a multi-layer winding having at least one turn about each of at least one pair of magnetic poles, each of said conductive film portions being configured to form a single continuous path enclosing each of said magnetic poles in such manner that each said path encloses one pole of each pair of said poles of each adjacent layer of said winding, each said path thereby continuing along a respective fold of the multi-layer stack of windings, said winding further comprising connecting means for electrically connecting said conductive films together.

6. The winding of claim 5, comprising two said pairs of magnetic poles.

7. The winding of claim 6 wherein each said path formed by each of said conductive film portions has a shape comprising two generally ovoid portions connected together at a midportion.

8. The winding of claim 7 wherein said connecting means comprises conductive bridges and vias for connecting adjacent winding layers together along alternate folds of said stack wherein the conductive film portions are folded toward each other, said connecting means further comprising conductive connecting strips for connecting the conductive bridges together and for directly connecting the conductive films together on the opposite side of said stack.

* * * * *